United States Patent [19]

Clements

[11] Patent Number: 4,860,915

[45] Date of Patent: Aug. 29, 1989

[54] BAGHOUSE WITH INTEGRAL WALL STIFFENERS

[75] Inventor: Jack T. Clements, Raytown, Mo.

[73] Assignee: Standard Havens, Inc., Kansas City, Mo.

[21] Appl. No.: 75,442

[22] Filed: Jul. 20, 1987

[51] Int. Cl.[4] ..... B65D 88/26; B65D 90/02

[52] U.S. Cl. ..... 220/4 R; 52/194; 52/588; 52/630; 55/385.2; 220/72; 220/76; 220/83

[58] Field of Search ..... 52/192, 194, 578, 581, 52/587, 588, 630, 782; 55/385 A, 385 C, 96; 220/1.5, 4 C, 4 F, 4 R, 5 A, 72, 75, 76, 83

[56] References Cited

U.S. PATENT DOCUMENTS

| | | | |
|---|---|---|---|
| 1,943,191 | 1/1934 | Schwemlein | 330/5 A |
| 2,142,110 | 1/1939 | Calkins et al. | 52/579 |
| 2,897,620 | 8/1959 | Fitzgerald | 52/588 |
| 4,546,590 | 10/1985 | Finch et al. | 52/588 |
| 4,694,736 | 9/1987 | Yamagata et al. | 55/385 |

FOREIGN PATENT DOCUMENTS

| | | | |
|---|---|---|---|
| 0253186 | 7/1966 | Austria | 52/388 |
| 1371974 | 8/1964 | France | 220/1.5 |
| 0609254 | 9/1960 | Italy | 220/5 A |
| 0105985 | 5/1917 | United Kingdom | 52/588 |

OTHER PUBLICATIONS

"Flex-Kleen", Advertisement, 2 pages, 10-1958, 55-341.

*Primary Examiner*—Jimmy G. Foster
*Attorney, Agent, or Firm*—Kokjer, Kircher, Bradley, Wharton, Bowman & Johnson

[57] ABSTRACT

A housing for an industrial baghouse constructed of a plurality of panels having a stiffening element integral with the wall. Each panel is similarily constructed in the shape of an elongated "U". The panels are arranged upright in juxtaposition to, and in an alternating manner with, each adjoining panel. A channel is formed between two adjoining panels by overlapping the ends of each panel with the next adjoining panel. This channel creates a stiffening element to give structural rigidity to the housing wall. A housing wall so constructed can withstand the internal pressure associated with a baghouse.

2 Claims, 1 Drawing Sheet

BAGHOUSE WITH INTEGRAL WALL STIFFENERS

BACKGROUND AND SUMMARY OF THE INVENTION

This invention relates in general to industrial baghouses and more particularly to a baghouse housing constructed with integral wall stiffeners.

Continuous emphasis on environmental quality has resulted in considerable importance being attached to the control of industrial emissions. One technique that has proven highly effective in controlling air pollution has been the separation of undesirable particulate matter from a gas stream by fabric filtration.

Such filtration is carried out in dust collection apparatus known in the trade as a "baghouse" that operates on the same general principle as an ordinary vacuum cleaner, except on a much larger scale. The baghouse includes a sheet metal housing that is divided by one or more tube sheets into two chambers referred to as plenums. Disposed in openings in the tube sheet are fabric filters. A particle laden gas stream is passed initially into one chamber (the dirty gas plenum) where dust accumulates on the fabric filter as the gas flows through the fabric into the other chamber (the clean gas plenum) and out of the unit through an exhaust duct.

Although all baghouses are constructed in accordance with the foregoing principles, there are numerous operational and structural differences among the various types of baghouses. The present invention is applicable to any variety of baghouse and the type described and depicted herein is merely representative of the use of the invention in a typical baghouse.

In a typical baghouse, filtration occurs from the outside to the inside of each bag. In this type of baghouse, referred to as an outside bag collector, the dirty and clean gas plenums are separated by the tube sheet and the filter bags are suspended from the tube sheet. An exhaust duct is connected to the clean gas plenum and located within the exhaust duct is a fan or other similar means for creating a gas current through the baghouse. The fan creates an air current or "pull" through the baghouse. The particle laden gas enters the dirty gas plenum through an inlet, and passes through the filters and into the clean gas plenum. The resulting clean gas is drawn out through the exhaust duct. The gas current through the baghouse creates a negative pressure within the baghouse. This negative pressure creates stress on the housing of the baghouse, especially the dirty gas plenum walls.

Also creating stress on the baghouse housing walls is external wind loads. The baghouse housing walls are exposed to the elements of nature and must be structurally strong enough to withstand the pressure forced upon it by wind. The structure must be of sufficient strength so that the walls of the baghouse are not destroyed or deformed by external wind.

As can obviously be seen, the same problem would exist in a baghouse that forces gas through the baghouse by creating a positive pressure within the baghouse. This positive pressure would also create stress on the baghouse walls.

In order to alleviate this stress on the baghouse walls, and to keep the walls from "buckling in" under the negative pressure, baghouses built before the onset of the present invention have employed separate wall stiffeners to support the housing walls. These wall stiffeners generally take the shape of a tubular or angular channel piece of steel that is interspersed along the inner or outer wall of the housing to act as support beams. The baghouse housing wall of this type of baghouse typically consisted of a plurality of flat upright panels of sheet metal welded together to form the "box-like" housing. These separate wall stiffeners were then welded to the wall at appropriate intervals along the wall. This method requires numerous welds to hold the housing together, one at each end of each panel to join it with the next adjoining panel and at least two additional welds to secure the separate stiffener to the wall. This method of supporting the walls also requires the fabrication of two separate elements to form the wall; the flat panels and the stiffener piece. This multitude of welds and the requirement of fabricating two separate parts to construct a baghouse housing wall strong enough to withstand the pressure applied to it is costly and inefficient. Thus, there is a need for a baghouse that is structurally strong enough to withstand the pressure inherent in a baghouse and that is also cost effective and efficient. It is a primary goal of the present invention to provide such a baghouse.

More specifically, it is an object of the invention to provide a baghouse that provides structural rigidity in an economical manner.

Another object of the invention is to provide a baghouse housing wall where only a single type of panel, all being of a uniform shape, is required to both construct the housing walls and to provide the stiffening element.

An additional object of the invention is to provide a baghouse housing wall where fewer welds are required to construct the wall thereby reducing cost and increasing efficiency.

A further object of the invention is to provide a baghouse where the stiffening element is integral with the wall.

A still further object of the invention is to provide a baghouse where the housing wall is constructed with individual panels each shaped generally in an elongated "U" so that when the panels are arranged in a "side-by-side" manner a channel is created between each adjoining panel that serves as the stiffening element for the wall.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE DRAWINGS

Figure 2:
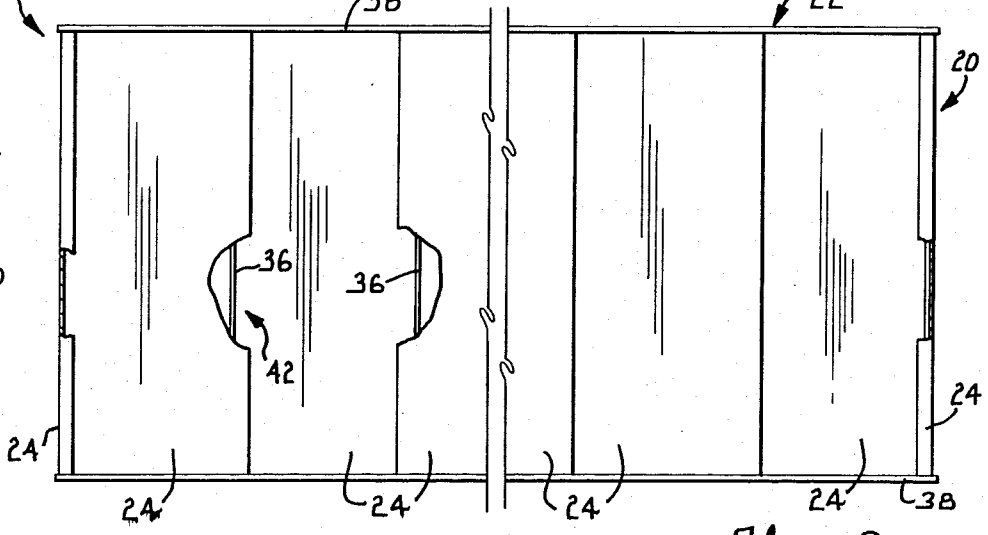
FIG. 2 is a side elevational view of a wall of a baghouse constructed in accordance with a preferred embodiment of the present invention partially cut away to show the interrelationship of the individual panels.

Referring now to the drawings in greater detail, numeral 10 designates a baghouse having a housing made of a material sufficiently strong to withstand pressure, corrosive elements and environmental stress.

Figure 1:
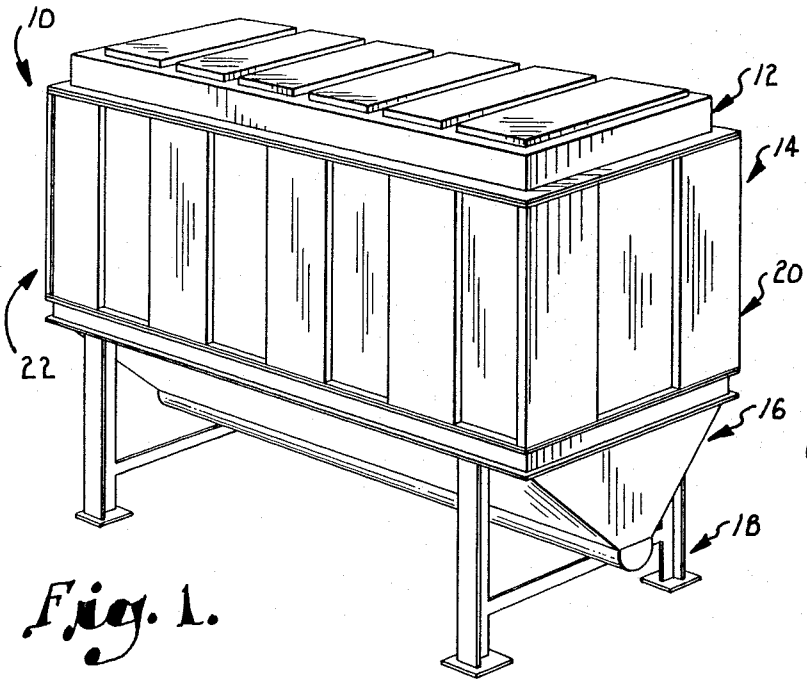
FIG. 1 is a perspective view of a baghouse constructed in accordance with a preferred embodiment of the present invention.

With reference to FIG. 1, the baghouse of the type described has a clean gas plenum 12 which can be permanently affixed or removably situated atop a dirty gas plenum 14. The dirty gas plenum 14 is located atop a hopper shaped lower housing section 16. The housing is supported by a plurality of legs 18.

The dirty gas plenum 14 includes a pair of end walls 20 and a pair of sidewalls 22 (only one of each being shown in FIG. 1). The dirty gas plenum 14 has at least one inlet (not shown) into which the process gas containing particulate matter is introduced. Not shown, but within the dirty gas plenum, are the fabric filters and associated apparatus whereby the process gas is filtered and cleaned. The clean gas moves into the clean gas plenum 12 which has at least one outlet (not shown) through which the filtered air is discharged from the baghouse. Each outlet is equipped with a fan or other means (not shown) that operates to create the gas current that pulls the process gas through the baghouse 10 in the usual manner.

With particular reference to FIG. 1, both sidewalls 22 and endwalls 20 of dirty gas plenum 14 are constructed with a plurality of similarly shaped individual panels 24. The sidewalls 22 and endwalls 20 can be of any size and any number of panels 24 may be used. The walls terminate with an end panel 24.

Figure 4:
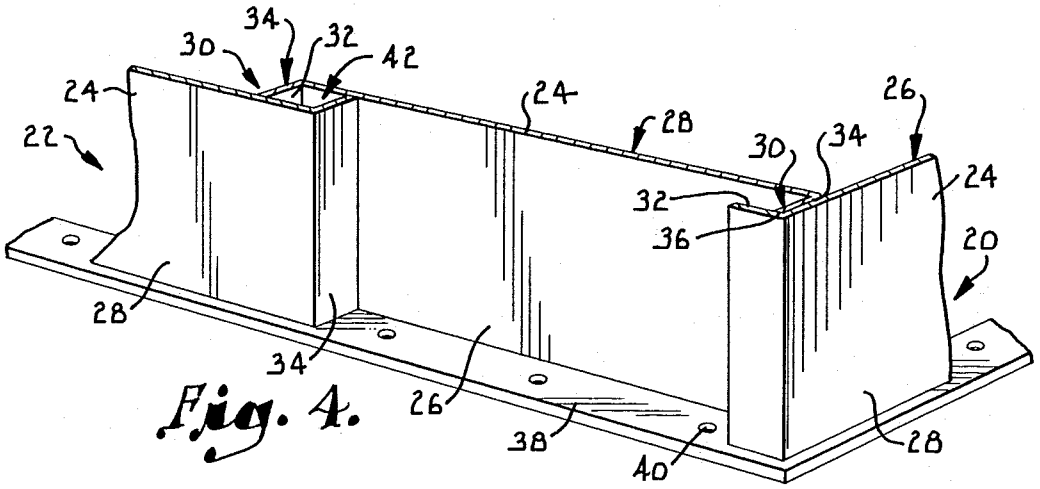
FIG. 4 is a fragmentary perspective view of another corner formed by the present invention and also showing the interrelationship between adjoining panels.

As best shown in FIG. 4, each individual panel 24 is similarly constructed and is generally shaped in an elongated "U". Each panel 24 has a front surface 26 and a back surface 28. Projecting outwardly from said front surface 26 are two opposing side surfaces 30. These side surfaces 30 each have an inner surface 32 and an outer surface 34. Each side surface 30 has an outer edge 36 which is best shown in the cutaway portion of FIG. 2. The panel 24 is normally placed in an upright position and has a top edge and a bottom edge. In a preferred embodiment of the invention each panel 24 has a flange 38 at the top edge and bottom edge of the panel. This top and bottom flange 38 can be seen in FIG. 2 and the bottom flange is more particularly depicted in FIGS. 3 and 4. Referring to flange 38 in FIG. 4, the flange has openings 40 through the flange and interspersed along the flange to accept means to join the panels 24 of the dirty gas plenum to the hopper assembly 16 below the dirty gas plenum and to the clean gas plenum 12 above the dirty gas plenum.

When forming individual panels 24, the preferred method is to start with a flat piece of suitable material, usually sheet metal, of the desired size and then bend both ends of the flat piece to form the side surfaces 30 of panel 24.

When constructing the "boxlike" dirty gas plenum 14, the individual panels 24 are placed in an upright position with the side surfaces 30 of each panel projecting toward the front surface 26 of the adjoining panels. As best shown in FIG. 4, when forming a wall of the dirty gas plenum 14 by arranging the panels in the manner described above, the panels are positioned so as to form a channel 42 of a desired size between the side surfaces 30 and front surfaces 26 of two adjoining panels. The outer edge 36 of the side surface 30 of each individual panel 24 is then attached to the front surface 26 of the adjoining panel. The means of attaching the panels to each other is typically by welding with the welds on the outside of the wall being airtight.

Referring particularly again to FIG. 2, a sidewall 22 constructed in the manner described above is shown where a plurality of panels 24 are arranged in a "side-by-side" manner with the side surfaces 30 of each panel projecting toward the front surfaces 26 of each adjoining panel 24 and with each panel 24 overlapping or interlocking with each adjoining panel 24 to form the channel 42 between the interlocking or overlapping areas. Said channel 42 being of a dimension large enough to provide structural support to the wall, but not being a channel so large to create virtually a double wall throughout. It has been found that a panel 24 with a side margin of 3" and with the overlapping area of each wall being 5", the channel 42 so formed is structurally sufficient to withstand the pressure within a baghouse. A channel 42 of smaller or larger dimensions is contemplated by this invention depending upon the needs of a particular baghouse, keeping in mind the objects of efficiency and economy. The channel 42 should generally function as a support beam and the panels 24 should be aligned in such a manner to provide this type of structure.

As can be seen in FIG. 2, the panels at the end of the sidewall 22 adjoin with the panels at the end of the endwalls 20 to form corners. Two types of corners may be formed depending upon the size of the baghouse constructed, and each type is generally shown in FIG. 2. The corner generally depicted on the left end of FIG. 2 is more particularly shown in FIG. 3.

Figure 3:
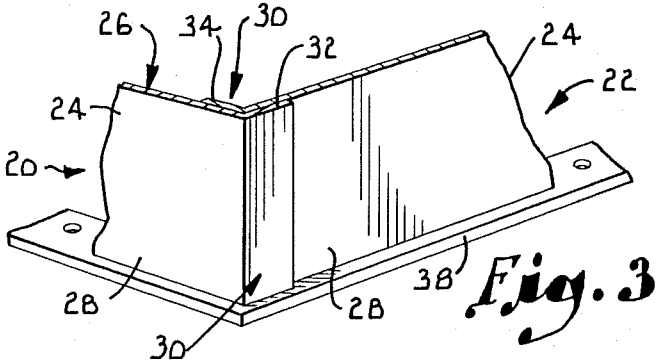
FIG. 3 is a fragmentary perspective view of a corner formed by the present invention and also showing the flanged edges of the panel of a preferred embodiment of the present invention.

In FIG. 3, an end panel 24 of sidewall 22 is shown with the back surfaces 28 being the outside of sidewall 22 with side surface 30 projecting inside the dirty gas plenum 14. An end panel 24 of endwall 20 is shown with the back surface 28 of end panel 24 being on the outside of the dirty gas plenum 14 with the side surfaces 30 projecting toward the inside of the dirty gas plenum 14. The outer surface 34 of side surface 30 of end panel 24 of sidewall 22 contacts with the front surface 26 of the end panel 24 of endwall 20 and the inner surface 32 of side surface 30 of end panel 24 of endwall 20 contacts with the back surface 28 of end panel 24 of sidewall 22 to form a corner.

FIG. 4 more particularly shows the corner generally depicted on the right end of FIG. 2. In FIG. 4, an end panel 24 of side wall 22 is arranged with the front surface 26 being on the outside of the dirty gas plenum 14 and with the side surfaces 30 projecting toward the outside of the dirty gas plenum 14. An end panel 24 of endwall 20 is arranged with the back surface 28 being on the outside of the dirty gas plenum 14 with the side surfaces 30 projecting toward the inside of the dirty gas plenum 14. To form the corner, the outer surface 34 of side surface 30 of end panel 24 of sidewall 22 contacts with the front surface 26 of end panel 24 of endwall 20 and the outer edge 36 of side surface 30 of end panel 24 of sidewall 22 contacts with the inner surface 32 of side surface 30 of end panel 24 of endwall 20.

It is contemplated that a plurality of panels 24 can be arranged in juxtaposition to each other and in an alternating and interlocking manner to form said channels 42 which form the stiffening element of the sidewalls 22 and endwalls 20. Said individual panels 24 can be connected to the next adjoining panel in a manner that provides an airtight dirty gas plenum 14 for an economically and environmentally efficient baghouse. Said dirty gas plenum 14 can be formed in a variety of heights merely by constructing the dirty gas plenum with panels 24 stacked one on top of another and attached by means of the openings in the flanges and by an airtight weld.

A baghouse constructed in the manner described above and utilizing the elements described above creates a baghouse structurally rigid enough to withstand the pressure within a baghouse and external wind loads in a most economical and efficient manner. The baghouse so constructed reduces the number of welds required to construct the baghouse, and by incorporating the stiffening element into the wall panel itself, this invention eliminates the need for additional elements to be constructed to form the baghouse housing walls.

From the foregoing, it will be seen that this invention is one well adapted to attain all the ends and objectives hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A housing for the separation of particulate matter from a gas stream, said housing being formed from a plurality of individual panels, each of said panels having a planar member and two spaced apart opposing sides integral with said planar member, each side presenting a free edge and each panel presenting top and bottom edges, said housing comprising:

interconnected walls, each wall formed by aligning said panels substantially upright and coupling together a plurality of said individual panels in an overlapping arrangement where each individual panel is in reverse orientation with respect to its adjoining panels, said walls being interconnected in a manner forming a rectangular housing;

a plurality of spaced apart channels presented along each of said walls, each channel being formed between two of said adjoining panels where said panels overlap when arranged in said overlapping, reverse orientation arrangement, whereby said channels form stiffening elements integral with said walls;

a flange extending outwardly from each of said top and bottom edges of each of said individual panels, said flange presenting means for attachment;

an upper structure coupled with said housing to provide a clean gas plenum;

a lower structure coupled with said housing; and supporting structures coupled with said lower structure in a manner supporting said housing above ground.

2. The housing as set forth in claim 1 wherein said lower structure is a hopper for catching and transporting said particulate matter out of said housing.

* * * * *